United States Patent [19]

Karlsson

[11] 4,194,308

[45] Mar. 25, 1980

[54] BOOT BLANK

[75] Inventor: Ulf R. Karlsson, Borås, Sweden

[73] Assignee: L-LT-Produkter, Borås, Sweden

[21] Appl. No.: 906,928

[22] Filed: May 18, 1978

[30] Foreign Application Priority Data

Jun. 15, 1977 [SE] Sweden ..... 7706894

[51] Int. Cl.[2] ..... A43B 1/02

[52] U.S. Cl. ..... 36/9 R; 36/2 R; 36/48; 12/142 G

[58] Field of Search ..... 36/9, 10, 47–49, 36/2 R, 1.5; 12/142 G

[56] References Cited

U.S. PATENT DOCUMENTS

| | | | |
|---|---|---|---|
| 26,436 | 12/1859 | Keffer | 36/48 |
| 331,561 | 12/1885 | Shaw | 36/9 R |
| 2,533,453 | 12/1950 | Gottschalk | 36/10 |
| 3,035,291 | 5/1962 | Bingham, Jr. | 36/9 R |
| 3,694,940 | 10/1972 | Stohr | 36/10 |
| 4,008,531 | 2/1977 | Schonbrun et al. | 36/2 R |

FOREIGN PATENT DOCUMENTS

| | | | |
|---|---|---|---|
| 1385328 | 11/1964 | France | 36/48 |

*Primary Examiner*—James Kee Chi

*Attorney, Agent, or Firm*—McFadden, Fincham & Co.

[57] ABSTRACT

There is provided a boot blank for a wading boot or the like, and as well a boot assembled from the boot blank with a leg encircling member for the assembled boot for hip-high wading boots. The boot blank has a novel structure with upper and lower portions, the lower portion having a planar bottom wall interrupted by a recess located generally centrally of the boot blank and along a central fold line with inwardly tapering side portions of the lower part meeting tapering side walls of the upper part. A triangular flap of the upper portion is adapted to be folded about the boot blank to join an opposite wall. The walls may be secured together by stitching or adhesive. The products are preferably made of an elastic cellular rubber-like material, such as "NEOPRENE", preferably provided with textile material laminated on both faces of the rubber material. The shape of the boot blank allows economical and easy manufacture of the boots and in addition, the products are self-supporting when worn by a user.

10 Claims, 1 Drawing Figure

BOOT BLANK

This invention relates to footwear.

More particularly, one aspect of this invention relates to a boot blank for forming footwear; another aspect of this invention relates to a boot made from such a boot blank and in a still further aspect of this invention, it relates to an assembled boot from the boot blank incorporating a leg protective member and as well, a method of forming the above products.

Although the footwear area for which the present invention is applicable can vary considerably, the invention is best described and illustrated with respect to footwear utilized as boots, or waders' boots, by fishermen, scuba divers, etc. As such, therefore, it will be described with respect thereto but it will be understood that the use of the present invention is not restricted thereto.

In the field of boots of the type worn by fishermen, one of the main objectives is to provide water protection for the wearer's feet—as is the case with the so-called "waders'" boots which are used by fishermen and which incorporate a leg portion affixed or otherwise secured to the boot.

At the present time, at least the top portion of the wader's boot is normally made of a relative thin material, such as fabric-backed rubber-coated material since the main purpose is to protect the user against the water. As is conventional, parties wearing the wader's boot will normally use straps, suspenders, or belts which are affixed to the wearer's body or to garments worn by the person using the boots.

Also, in many cases, such products may be of a molded configuration utilizing a one-step molding operation and while a one-step molding operation does possess some advantages in terms of economy in manufacturing steps, the particular types of material which can be used for this purpose are very limited. Other more desirable materials have to be formed by conventional procedures.

With this invention, applicant has developed a novel blank which may be used for forming the boot of products such as those described above; and still further, which may optionally have a leg portion attached to the boot formed from the boot blank of the present invention.

In accordance with this invention, there is provided a boot blank which comprises a boot blank for a wading boot or the like, comprising a body of flexible sheet material having an upper portion adapted to form an ankle-encircling member and a lower portion adapted to form a foot-encircling member, said upper and lower portions being adapted to be joined together to form a unitary body, said lower portion comprising a pair of side members each having a planar central portion meeting together along a central fold line for said boot blank, a substantially linear bottom margin, each bottom margin having a rounded shoulder proximate to said central fold line and together, said rounded shoulder of each portion forming an inwardly extending lower recess at said central fold line, said side members each having a rounded lateral side portion with an inwardly extending tapering side meeting said upper portion, said upper portion having a generally linear top margin with a pair of side portions, one of said side portions having an outwardly tapering side portion meeting one of said inwardly tapering side shoulders of said lower portion in an obtuse relationship, said upper portion having a triangularly shaped tab on the side opposed to said last-mentioned side, said triangularly shaped tab having an inwardly tapering side wall meeting said inwardly tapering side portion of said lower member in an acute angular relationship.

In another aspect of this invention, the above boot blank may be simply formed into a boot by securing the free lateral edges of the lower portion of the boot blank together so as to form a one-piece structure, and by placing the side wall of the triangularly shaped tab of the upper portion into juxtaposition with the opposed side wall of the upper portion and securing the same together.

In a still further embodiment of the present invention, there may also be provided a substantially linear blank adapted to form a leg-encircling portion for the boot, the blank having a pair of opposed side walls inwardly tapering from a wider upper portion to a narrower lower portion, the lower portion having a bottom wall substantially equal to the peripheral distance or length of the upper wall of the boot blank, the leg blank having an upper central portion extending beyond the sides of the blank, and which blank may be assembled by securing together the inwardly tapering side walls by suitable means, and whereafter the assembled blank may be fixedly secured to the upper portion of the boot assembled from the boot blank of the present invention.

In greater detail of the present invention, the material from which the products of the present invention are made, is a self-supporting material and most desirably, a cellular synthetic material which is preferablly substantially water impermeable. To this end, cellular rubber provided on one or both faces with a textile material secured thereto, may be employed. Particularly suitable for this purpose are the products marketed under the trademark "NEOPRENE" which are provided with textile material laminated or otherwise secured to one or both faces of the NEOPRENE material. Other synthetic materials of this type may also be employed. Whatever the material be, the thickness and density of the material should be so chosen that it is self-supporting when the boot blank is in an assembled condition and similarly, when the leg portion is likewise in an assembled condition. This does not mean, however, that when the leg assembly is fixedly secured to the boot made from the boot blank of the present invention, the two are self-supporting in the sense that the total weight, when one attempts to assemble the leg portion to the boot blank, will remain in an upright position since the total weight of the product will cause the product to collapse.

Using the above types of material, and particularly material such as NEOPRENE, thicknesses of 4 to 15 mm are normally sufficient to secure self-supporting components which are capable of being self-supporting when placed on a wearer's leg and foot so as to avoid suspenders, straps or the like for securing the products of the present invention to the wearer's body.

Also, in choosing a material for use with the products of the present invention, the materials should be flexible to permit the boot blank and leg blank to be assembled together, and for the sake of comfort when worn by a user. Materials such as NEOPRENE are capable of being adhesively secured together, and in some cases, particularly when provided with a fabric facing, may be stitched or sewn together.

In assembling the products of the present invention, any suitable means may be provided for securing the cooperating side edges or walls of the boot blanks, and leg blanks, together. As mentioned above, stitching may be employed or alternatively, adhesive may be employed which is compatible with the particular type of material utilized.

In preferred embodiments of the boot blank of the present invention, the boot blank is preferably provided with a pair of inwardly extending recesses or notches in the rounded shoulder portions forming the toe of the assembled boot. It has been found that by employing notches, and due to the flexible nature of the material, a better fitting boot can be provided—likewise, a better contour for the boot can be achieved. Still further, it is most desirable that the upper side walls of the ankle-encircling portion of the boot blank be in a substantially parallel relationship whereby when the triangular flap of the ankle-encircling portion is rotated to be secured in juxtaposition with the opposed portion of the boot blank, the resulting assembly provides a substantially continuous wall structure. The angular relationship of the walls relative to the top free wall of the boot blank may vary, but for the purposes of the present invention, one can achieve the ready assembly of the boot blank by having one side wall of the upper portion of the blank form an acute angle with the lower portion of the boot blank, while the other wall conversely forms an obtuse angular relationship with the side wall of the lower portion of the boot blank.

The boot blanks of the present invention provide a very economical and easy method of manufacturing products such as wading boots. The configuration of the boot blank provides a particularly desirable contour to the boots. Once cut from lengths of material, the boot blanks may be assembled using conventional means such as stitching or adhesive. Boots made out of the rubber-like elastic material as described heretofore and hereinafter possess many advantageous features compared to prior art proposals—for example, they may utilize materials which are readily available to those skilled in the art and which could not be used for manufacturing such products in prior art molding processes—moreover, the boot assemblies comprising the boot portion and the leg members can be used to form wading boots which are self-supporting eliminating the need for suspenders, belts or the like.

The products of the present invention may also be incorporated into wet-suits for scuba-divers, and as well, they will find other uses in various industrial areas.

Having thus generally described the invention, reference will now be made to the accompanying drawings illustrating preferred embodiments, and in which.

Figure 1:
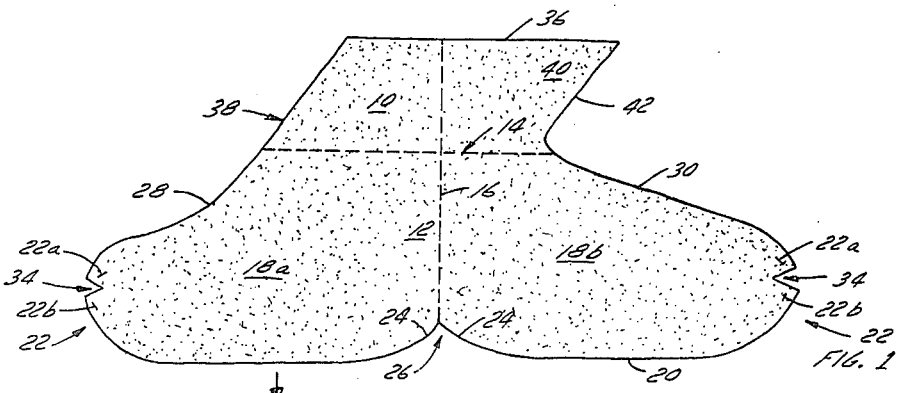
FIG. 1 is a top plan view of a boot blank according to the present invention.

Referring to FIG. 1, there is illustrated a boot blank made of a cellular rubber-like material which is laminated with a textile material, for example, a woven material, and which has been die-cut or otherwise cut-out to the shape illustrated in FIG. 1. To this end, the boot blank of FIG. 1, as shown in a scale larger than that of FIGS. 2 to 6 for illustrative purposes, comprises an upper portion indicated generally by reference numeral 10 and a lower portion indicated generally by reference numeral 12, the upper and lower portions being shown as being separated by the dotted line 14 for illustrative purposes only.

The boot blank is adapted to be folded along a central fold line again indicated by dotted line 16 from the top to the bottom thereof, and which fold line will be located vertically in the boot blank and which is adapted to be located at the rear of a wearer's foot.

The boot blank of FIG. 1 is a one-piece or integral layer of material of a thickness to be self-supporting. The upper portion designated generally by reference numeral 10 is adapted to form an ankle-encircling member while the lower portion designated generally by reference numeral 12 is adapted to form a foot-encircling member including the sole portion. Conversely, each part of the boot blank illustrated in FIG. 1 on the side of the central fold line forms generally one half of a boot made from the boot blank of FIG. 1.

The lower body portion 12, about each side of the central fold line 16, comprises a pair of side members designated by reference numerals **18*a* and 18*b*, each having a planar central portion which meet along the central fold line. Each portion 18*a* and 18*b* has a substantially linear bottom portion 20 which are adapted to be joined together as described hereinafter, to form the bottom portion of the sole. Each bottom portion has a rounded shoulder designated generally by reference numeral 22 on the outer or free lateral margins of the side portions 18*a* and 18*b*, while a similar interiorly located rounded shoulder portion for each side portion 18*a* and 18*b* is designated generally be reference numeral 24. These latter rounded side portions together form an inwardly extending recess 26 located proximate to the central fold line 16. By providing the inwardly extending recess 26 in the boot blank, the boot blank when folded along the central line 16** will conform to the ball of a wearer's foot and permit the shaping of the product without other costly steps or cut-outs.

Each side portion **18*a* and 18*b* includes an inwardly tapering side wall designated by reference numerals 28 and 30** which at their lower end, meet their respective rounded shoulders, and at the upper end, blend in with the upper portion of the boot blank as described hereinafter.

In a preferred embodiment, each section **18*a* and 18*b* is provided, in the rounded shoulder portion 22, with an inwardly extending triangular cut-out indicated by reference numeral 34 which forms a notch whereby the adjacent areas 22*a* and 22*b* of the shoulder are compressed together and secured (as hereinafter described) to form a continuous toe portion for the boot resulting from the use of the boot blank. The cut-out portion 34 thus provides a simple and effective means of forming a boot blank having the desired contours and configuration without the necessity of subsequent steps to remove excess material during assembly of the boot. The upper portion of the boot blank which forms the ankle-encircling portion 10, has a generally linear top margin 36 and like the bottom portion, has a substantially planar central portion. As viewed in FIG. 1, the left-hand side has an outwardly tapering side 38** which meets the side wall 28 of the section 18*a* in an obtuse angular relationship; on the opposite side, the upper portion includes a generally triangularly shaped flap designated by reference numeral 40 which has an inwardly tapering side wall 42 meeting the inwardly tapering side wall 30 in an acute angular relationship. By forming the boot blank in this manner, a boot may be assembled from the blank in a very easy manner as will be described with reference to FIGS. 2 and 3.

Figure 2:
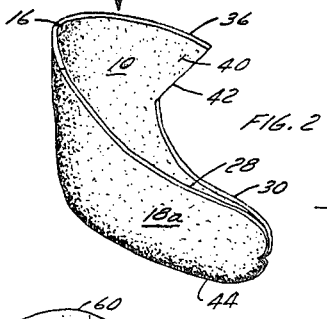
FIG. 2 illustrates the boot blank of FIG. 1 in a partially formed condition as the first step in forming a boot using the blank of the present invention.
Figure 3:
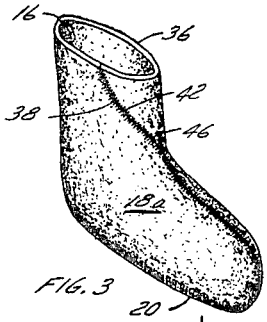
FIG. 3 illustrates a formed boot using the blank of FIG. 1.

With reference to FIGS. 2 and 3, the sequential assembly of the boot from the boot blank is illustrated and to this end, the bottom portions 20 are secured together by suitable means such as a line of stitching 44, or the like. As will be noted form FIGS. 2 and 3, the halves of the boot blank illustrated in FIG. 1 are folded about the fold line 16 to accomplish this. Sequentially, the triangular flap 40 is then folded so that the side wall 42 lies in juxtaposition with the side wall 38. Thus, in a preferred embodiment of the present invention, the side wall 42 and the side wall 38 of the upper portion of the boot blank are preferably in a substantially parallel relationship to achieve a smooth contour for the ankle-encircling portion of the boot, whereafter, they are sewn or otherwise secured together by means of stitching 46 as illustrated in FIG. 3. At the time of securing the respective halves together, the portions 22*a* and 22*b* of the shoulders are "closed" so that recess 34 is eliminated resulting in the article illustrated in FIG. 3. Still further, in a preferred embodiment of the above, upon assembly, and as will be noted from FIGS. 2 and 3, the inwardly tapering walls 28 and 30 of the lower portion of the boot blank are preferably located in a substantially similar angular relationship to the top free margin 36 of the boot blank to provide the contour illustrated in these latter figures.

Figure 4:
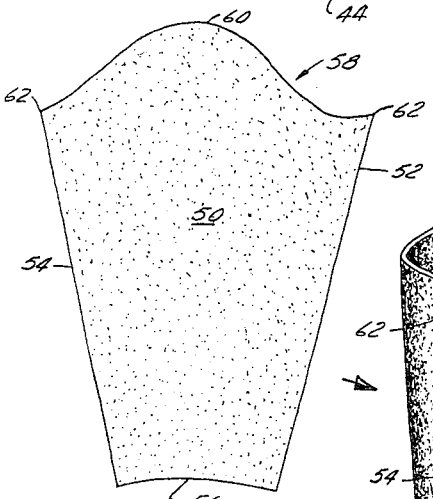
FIG. 4 illustrates a leg blank for use in combination with the boot.

Referring now to FIG. 4, there is illustrated a leg blank for use in combination with the boot of FIG. 3. To this end, a length of material such as that described with respect to the boot blank of FIG. 1, is also utilized for the leg blank illustrated in FIG. 4. The leg blank comprises a generally planar body 50 having a pair of opposed inwardly tapering side walls 52 and 54 which commence from a larger upper portion to a narrower bottom portion which is adapted to be joined with an assembled boot such as is illustrated in FIG. 3. The lower portion includes a generally planar bottom margin 56 which has a width between the opposed side walls 52 and 54 substantially equal to the perimeter of the upper wall 36 of the boot.

The upper portion of the blank includes an upper wall 58 extending between the side walls 52 and 54 and which includes a central rounded portion 60 of a length greater than the length on either lateral side. The end portions 62 of the upper portion are preferably located in the same plane—or expressed in other words, side walls 52 and 54 are of generally the same length.

Figure 5:
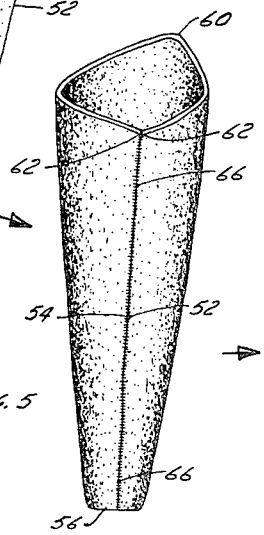
FIG. 5 illustrates the initial step in forming the leg blank into a leg sleeve.

As illustrated in FIG. 5, the side walls 52 and 54 are joined together, preferably in juxtaposition, by means of stitching 66 or the like. Assembly is carried out so that the lateral edges abut at the upper and lower portions for the upper and lower walls 56 and 62.

Figure 6:
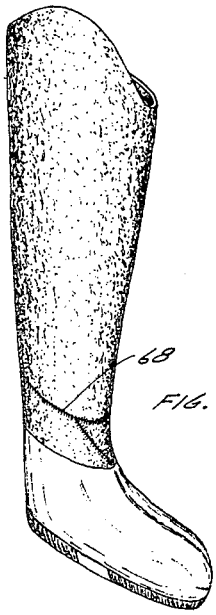
FIG. 6 illustrates the assembled leg and boot combination in its final form.

When the product is in the configuration illustrated in FIG. 5, the lower wall 56 may be abutted in juxtaposition with the wall 36 and secured together to form the product illustrated in FIG. 6, by means of stitching 68 or the like. In this manner, there is thus formed a one-piece wading boot.

An optional embodiment is also illustrated in FIG. 6 where the boot portion of FIG. 3 is dipped in a polymeric or other similar material—e.g., a latex solution, and subsequently vulcanized, so as to provide greater water repellency and insulation.

It will be understood that various modifications may be made to the above-described embodiments, without departing from the spirit and scope of the invention.

I claim:

1. A boot blank for a wading boot or the like, comprising a body of flexible sheet material having an upper portion adapted to form an ankle-encircling member and a lower portion adapted to form a foot-encircling member, said upper and lower portions being adapted to be joined together to form a unitary body, said lower portion comprising a pair of side members each having a planar central portion meeting together along a central fold line for said boot blank, a substantially linear bottom margin, each bottom margin having a rounded shoulder proximate to said central fold line and together, said rounded shoulder of each portion forming an inwardly extending lower recess at said central fold line, said side members each having a rounded lateral side portion with an inwardly extending tapering side meeting said upper portion, said upper portion having a generally linear top margin with a pair of side portions, one of said side portions having an outwardly tapering side portion meeting one of said inwardly tapering side shoulders of said lower portion in an obtuse relationship, said upper portion having a triangularly shaped tab on the side opposed to said last-mentioned side, said triangularly shaped tab having an inwardly tapering side wall meeting said inwardly tapering side portion of said lower member in an acute angular relationship.

2. A boot blank as defined in claim 1, wherein said side portions of said upper and ankle-encircling members are in a generally parallel relationship to each other.

3. A boot blank as defined in claim 1, wherein said rounded lateral side portions of said lower member are provided with recesses therein.

4. A boot blank as defined in claim 2, wherein said upper member has a substantially planar top wall in a generally parallel relationship to said substantially linear bottom margin of said lower portion, and said inwardly extending sides of said bottom portion being in substantially the same angular relationship relative to the top wall of said upper portion.

5. A boot blank as defined in claim 4, wherein said flexible sheet material comprises a cellular synthetic material.

6. A boot blank as defined in claim 5, wherein said cellular material comprises an elastic cellular rubber material having a facing on at least one side thereof of a textile material.

7. A boot made from the boot blank of claim 2.

8. A boot made from the boot blank of claim 3.

9. A boot assembly comprising a boot made from the boot blank of claim 2 together with a one-piece leg member, said leg member comprising a length of flexible sheet material having a bottom margin substantially equal in length to the circumference of the upper portion of the boot, said leg assembly being fixedly secured to said boot to form a one-piece leg and boot assembly.

10. A method of manufacturing a wading boot comprising the steps of providing a boot blank and a leg blank adapted to be secured to said boot blank, said boot blank comprising a body of flexible sheet material having an upper portion adapted to form an ankle-encircling member and a lower portion adapted to form a foot-encircling member, said lower portion comprising a pair of side members each having a planar central portion meeting together along a central fold line for said boot blank, a substantially linear bottom margin, each bottom margin having a rounded shoulder proximate to said central fold line and together, said rounded shoulder of each portion forming an inwardly extending lower recess at said central fold line, said side members each having a rounded lateral side portion with an inwardly extending tapering side meeting said upper portion, said upper portion having a generally linear top margin with a pair of side portions, one of said side portions having an outwardly tapering side portion meeting one of said inwardly tapering side shoulders of said lower portion in an obtuse relationship, said upper portion having a triangularly shaped tab on the side opposed to said last-mentioned side, said triangularly shaped tab having an inwardly tapering side wall meeting said inwardly tapering side portion of said lower member in an acute angular relationship, said leg blank comprising a trapezoidal shaped flexible body of sheet material having a narrower calf portion and a wider upper portion, fixedly securing the inwardly tapering wall of said triangularly shaped tab to the opposed wall of said upper portion of said boot blank, fixedly securing said bottom walls of said bottom portion to each other, and fixedly securing said inwardly tapering upper walls of said bottom portion to each other to form an assembled boot blank, securing the opposed lateral side walls of said trapezoidally shaped leg portion together, and securing the bottom portion of the resulting assembled leg portion to the upper portion of said boot.

* * * * *